US009493710B2

(12) United States Patent
Koseoglu et al.

(10) Patent No.: US 9,493,710 B2
(45) Date of Patent: Nov. 15, 2016

(54) PROCESS FOR STABILIZATION OF HEAVY HYDROCARBONS

(75) Inventors: Omer Refa Koseoglu, Dhahran (SA); Adnan Al-Hajji, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 796 days.

(21) Appl. No.: 13/553,236

(22) Filed: Jul. 19, 2012

(65) Prior Publication Data

US 2013/0026074 A1 Jan. 31, 2013

Related U.S. Application Data

(60) Provisional application No. 61/513,457, filed on Jul. 29, 2011.

(51) Int. Cl.

| | |
|---|---|
| ***C10G 21/14*** | (2006.01) |
| ***C10G 21/00*** | (2006.01) |
| ***C10G 31/06*** | (2006.01) |
| ***C10G 21/28*** | (2006.01) |
| ***C10G 1/00*** | (2006.01) |

(52) U.S. Cl.

CPC ..... *C10G 21/003* (2013.01); *C10G 1/002* (2013.01); *C10G 21/14* (2013.01); *C10G 21/28* (2013.01); *C10G 31/06* (2013.01); *C10G 2300/107* (2013.01); *C10G 2300/1077* (2013.01); *C10G 2300/206* (2013.01); *C10G 2300/4075* (2013.01); *C10G 2300/44* (2013.01)

(58) Field of Classification Search

CPC .... C10G 21/003; C10G 21/14; C10G 21/28; C10G 31/06; C10G 53/04

See application file for complete search history.

(56) References Cited

U.S. PATENT DOCUMENTS

| | | | |
|---|---|---|---|
| 3,775,292 | A | 11/1973 | Watkins |
| 3,968,023 | A | 7/1976 | Yan |
| 4,017,383 | A | 4/1977 | Beavon |
| 4,101,415 | A | 7/1978 | Crowley |
| 4,125,458 | A | 11/1978 | Bushnell et al. |
| 4,239,616 | A | 12/1980 | Gearhart |

(Continued)

FOREIGN PATENT DOCUMENTS

| | | | |
|---|---|---|---|
| EP | 0187947 | A1 | 7/1986 |
| WO | 97/21786 | A1 | 6/1997 |

(Continued)

OTHER PUBLICATIONS

International Preliminary Report on Patentability issued Feb. 4, 2014 in corresponding International Application No. PCT/US2013/0437328.

(Continued)

*Primary Examiner* — Renee E Robinson

(74) *Attorney, Agent, or Firm* — Abelman, Frayne & Schwab

(57) ABSTRACT

A process for stabilization of heavy hydrocarbons to reduce sludge formation in storage tanks and/or transportation lines and to enhance the hydrocarbon yield includes mixing a paraffinic or heavy naphtha solvent having carbon numbers in the range 10 to 20 with the feedstock to solvent-flocculate a relatively small, predetermined portion of asphaltenes present in the feedstock, separating and flashing the sediment to recover a light hydrocarbon fraction, flashing the heavy hydrocarbon/solvent phase and recycling the solvent to stabilize the heavy hydrocarbons without significantly affecting the yield of valuable products.

11 Claims, 2 Drawing Sheets

(56) References Cited

U.S. PATENT DOCUMENTS

| | | | | | |
|---|---|---|---|---|---|
| 4,279,739 | A * | 7/1981 | Roach | 208/309 |
| 4,290,880 | A | 9/1981 | Leonard | |
| 4,305,814 | A | 12/1981 | Leonard | |
| 4,411,790 | A | 10/1983 | Arod et al. | |
| 4,482,453 | A | 11/1984 | Coombs et al. | |
| 4,502,944 | A | 3/1985 | Nelson | |
| 4,514,287 | A * | 4/1985 | Ikematsu et al. | 208/309 |
| 4,572,781 | A | 2/1986 | Krasuk et al. | |
| 4,619,768 | A | 10/1986 | Takahashi et al. | |
| 4,663,028 | A | 5/1987 | Ditman | |
| 4,686,028 | A * | 8/1987 | Van Driesen et al. | 208/86 |
| 4,747,936 | A | 5/1988 | Penning | |
| 4,810,367 | A | 3/1989 | Chombart et al. | |
| 4,816,140 | A | 3/1989 | Trambouze et al. | |
| 5,728,291 | A | 3/1998 | Miller et al. | |
| 5,944,984 | A * | 8/1999 | Benguigui et al. | 208/309 |
| 6,106,701 | A * | 8/2000 | Hart | C10G 21/003 208/309 |
| 7,172,686 | B1 * | 2/2007 | Ji et al. | 208/354 |
| 2007/0295640 | A1 | 12/2007 | Tan et al. | |
| 2009/0200209 | A1 * | 8/2009 | Sury | C10G 1/045 208/390 |

FOREIGN PATENT DOCUMENTS

| | | | |
|---|---|---|---|
| WO | 97/34966 | A1 | 9/1997 |
| WO | 2006/032286 | A1 | 3/2006 |

OTHER PUBLICATIONS

Written Opinion mailed Aug. 29, 2013 in corresponding International Application No. PCT/US2013/0437328.
International Search Report mailed Aug. 29, 2013 in corresponding International Application No. PCT/US2013/0437328.

* cited by examiner

PROCESS FOR STABILIZATION OF HEAVY HYDROCARBONS

RELATED APPLICATIONS

This application claims priority to provisional patent application U.S. Ser. No. 61/513,457 filed Jul. 29, 2011, the contents of which are incorporated herein by reference.

BACKGROUND OF THE INVENTION

1. Field of the Invention

The present invention relates to a process for stabilization of heavy hydrocarbons by efficiently preventing sludge formation in storage tanks and/or transportation lines.

2. Description of Related Art

The composition of crude oils and their heavy hydrocarbon fractions varies greatly depending upon their geographic origins and types. Properties of several sample vacuum residues derived from various crude oils are shown in Table 1. As can be seen from Table 1, vacuum residues can have a sulfur content that ranges from 0.2 to 7.7 W % and a nitrogen content that ranges from 3800 to 7800 parts per million by weight (ppmw). Vacuum residues can also contain metals such as nickel and vanadium which make them difficult to process, since they deactivate or poison the catalysts used.

TABLE 1

Properties of Sample Vacuum Residues

| Source | Taching | Brent | Kirkuk | Safaniya | Athabasca | Boscan | Rospomare |
|---|---|---|---|---|---|---|---|
| Specific Gravity | 0.932 | 0.984 | 1.021 | 1.04 | 1.038 | 1.035 | 1.065 |
| API Gravity | 20.3 | 12.3 | 7.1 | 4.6 | 4.8 | 5.2 | 1.4 |
| Viscosity @ 100° F. | 175 | 380 | 870 | 4000 | 1300 | 4000 | 3500 |
| Sulfur W % | 0.2 | 1.57 | 5.23 | 5.42 | 4.94 | 5.56 | 7.66 |
| Nitrogen ppmw | 3800 | 4700 | 4000 | 4300 | 5700 | 7800 | 4200 |
| Conradson Carbon Residue (CCR) | 9.4 | 16.5 | 18 | 24.6 | 16.7 | 19.3 | 26.3 |
| $C_5$-Insolubles | 0.8 | 3.5 | 15.7 | 23.6 | 17.9 | 23.2 | 35.2 |
| $C_7$-Insolubles | 0.3 | 1 | 7.7 | 13.6 | 10.2 | 14.1 | 23.9 |
| Nickel (Ni) | 10 | 11 | 52 | 44 | 101 | 121 | 71 |
| Vanadium (V) | 7 | 38 | 125 | 162 | 280 | 1330 | 278 |

In addition, the vacuum residues shown in Table 1 contain asphaltenes that can range from 0.3 to 35 W %, depending upon the source of the crude oil. Asphaltenes are defined as the particles precipitated by addition of a low-boiling paraffin solvent such as normal-pentane. They are solid in nature and comprise polynuclear aromatic hydrocarbons.

The chemistry of asphaltenes is complex. It is known that the asphaltene molecular composition differs from one asphaltene to another depending on the solvent type used, operating conditions and the oil source. It is also known that the amount of asphaltenes decreases with an increase in the carbon number of the solvent used to separate the asphaltenes, but with a loss in the quality of the treated oil. The asphaltenes recovered using high carbon number solvents are highly condensed structures and are likely to form sediment when there is a change of conditions, i.e., in processing or during storage.

The structure of the oil phase is well explained by Pfeiffer and Saal, who proposed a colloidal model of petroleum as schematically illustrated in FIG. 1. According to this model, asphaltenes are dispersed by resin molecules and small molecules such as aromatics that act as a solvent for the asphaltenes-resin dispersion; hydrocarbons are present as a non-solvent. If the oil composition is altered, i.e., by adding more hydrocarbon saturates or removing resins by means of reaction or physical separation, the equilibrium between the oil components changes, in which case asphaltenes start to flocculate out of the solution and can coalesce and precipitate.

Asphaltenes start to precipitate in oil storage tanks and/or transportation lines once they flocculate out of the solution. The accumulated precipitate of asphaltenes form a hard sediment, also referred to as "sludge." The technical problems created by sludge formation include blockage of pipelines and burner nozzles, reduction in storage capacity, pump malfunctions, corrosion, false measurements and plugging. The factors controlling the sludge formation are oxidation, electrostatic charging, coagulation, volatility and the precipitation of wax and solid components, which usually result from changed conditions. Routine industrial maintenance of storage tanks unavoidably means the temporary inoperability of equipment. Furthermore, when conventional treatments are used to remove sludge, there is a potential for a significant negative environmental impact.

Solvent deasphalting is a process employed in oil refineries to extract valuable components from residual oil. The extracted components can be further processed in the refinery where they are cracked and converted into lighter fractions, such as gasoline and diesel. Suitable residual oil feedstocks which can be used in solvent deasphalting processes include, for example, atmospheric distillation bottoms, vacuum distillation bottoms, crude oil, topped crude oils, coal oil extract, shale oils, and oils recovered from tar sands. Solvent deasphalting processes are well known and described, for instance, in U.S. Pat. No. 3,968,023, U.S. Pat. No. 4,017,383 and U.S. Pat. No. 4,125,458, all of which disclosures are incorporated herein by reference.

In a typical solvent deasphalting process, a light hydrocarbon solvent, which can be a combination of one or more paraffinic compounds, is admixed with a residual oil feed to flocculate and separate the solids formed from the oil. Common solvents and their mixtures used in the deasphalting process include normal and/or iso-paraffins with carbon numbers ranging from 1 to 7, preferably from 3 to 7, including most preferably, propanes, normal and/or iso butanes, pentanes, hexanes, and heptanes. Under elevated temperatures and pressures, generally below the critical temperature of the solvent, the mixture is separated into two liquid streams, including (1) a substantially asphaltenes-free stream of deasphalted oil, and (2) a mixture of asphaltenes and solvent that includes some dissolved deasphalted oil.

While the solvent deasphalting process can be effective in removing almost all of the asphaltenes from the feedstock and thereby reduce sludge formation, a large portion of feedstock is rejected as asphalt due to the nature of the low carbon number paraffinic solvent used, resulting in a large loss in yield.

The problem addressed by the present invention is how to efficiently process heavy hydrocarbon feeds to prevent sludge formation in storage tanks and/or transportation lines while minimizing any adverse effects on the quality and yield losses of the hydrocarbon stream that is treated.

SUMMARY OF THE INVENTION

The present invention broadly comprehends a process for the stabilization of heavy hydrocarbons that prevents sludge formation in storage tanks and/or transportation lines by removing a portion of asphaltenes that are sediment precursors and preventing further sediment formation, the process including the steps of:

a. mixing a solvent with a heavy hydrocarbon feedstock containing asphaltenes to solvent-flocculate a portion of the asphaltenes that are sediment precursors present in the feedstock;

b. heating the combined stream of feedstock and solvent to produce feedstock containing solvent-flocculated asphaltenes;

c. separating the feedstock containing solvent-flocculated asphaltenes in a contact vessel into a solvent/hydrocarbon phase and a sediment phase;

d. flashing the solvent/hydrocarbon phase to produce a sediment-free hydrocarbon fraction and a solvent fraction;

e. flashing the sediment phase to produce a sediment bottom fraction and a light hydrocarbon fraction;

f. flashing the light hydrocarbon fraction to produce a sediment-free hydrocarbon fraction and a solvent fraction;

g. recycling the solvent fractions produced in steps (d) and (f) to step (a); and h. recovering the sediment-free hydrocarbon fractions produced in steps (d) and (f).

As used herein, the term "sediment-free" fraction is used for convenience and means a fraction that has been treated in accordance with the process of the invention, which fraction is substantially free of sediment, but can contain a small proportion of sediment.

Solvents suitable for use in the process include paraffinic solvents having the formula $C_nH_{2n+2}$, where n=10 to 20, and heavy naphtha solvents having a carbon number in the range of from 10 to 20, and mixtures thereof.

The heavy hydrocarbon feed can be stabilized by removing from as little as 0.1 W % and up to 10 W % by the solvent-flocculation and treatment process of the invention.

The process and system described herein provide the following benefits:

1. Heavy hydrocarbons are stabilized during production, storage, transportation and refining processes.

2. High carbon number paraffinic or heavy naphtha solvents, e.g., $C_{10}$ to $C_{20}$ are used only to remove asphaltenes that are sediment precursors and to prevent further sediment formation. The sludge formation is reduced while yield loss is minimized.

3. The relatively low temperature and pressure operating conditions in the contact vessel allows addition of the equipment required for the practice of the process at a relatively low cost. The choice of the types of contact vessels that are suitable for use in the process to be used is very broad.

4. The process has broad application to heavy hydrocarbons, particular whole crude oil and its heavy fractions.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are included to provide illustration and a further understanding of the various aspects and embodiments. The drawings, together with the remainder of the specification, serve to explain principles and operations of the described and claimed aspects and embodiments of the invention.

BRIEF DESCRIPTION OF THE DRAWINGS

The foregoing summary, as well as the following detailed description will be best understood when read in conjunction with the attached drawings, in which.

DETAILED DESCRIPTION OF THE INVENTION

Figure 1:
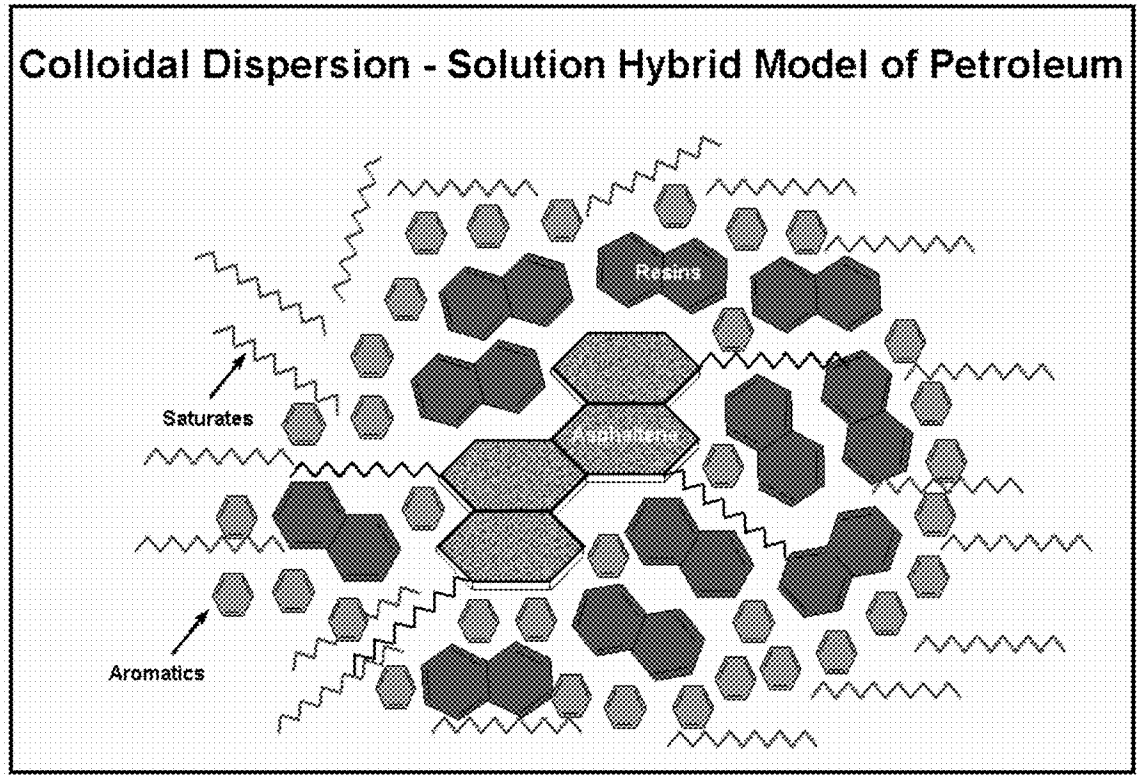
PRIOR ART FIG. 1
FIG. 1 is a schematic illustration that is representative of the nature of the colloidal dispersion of a petroleum mixture.
Figure 2:
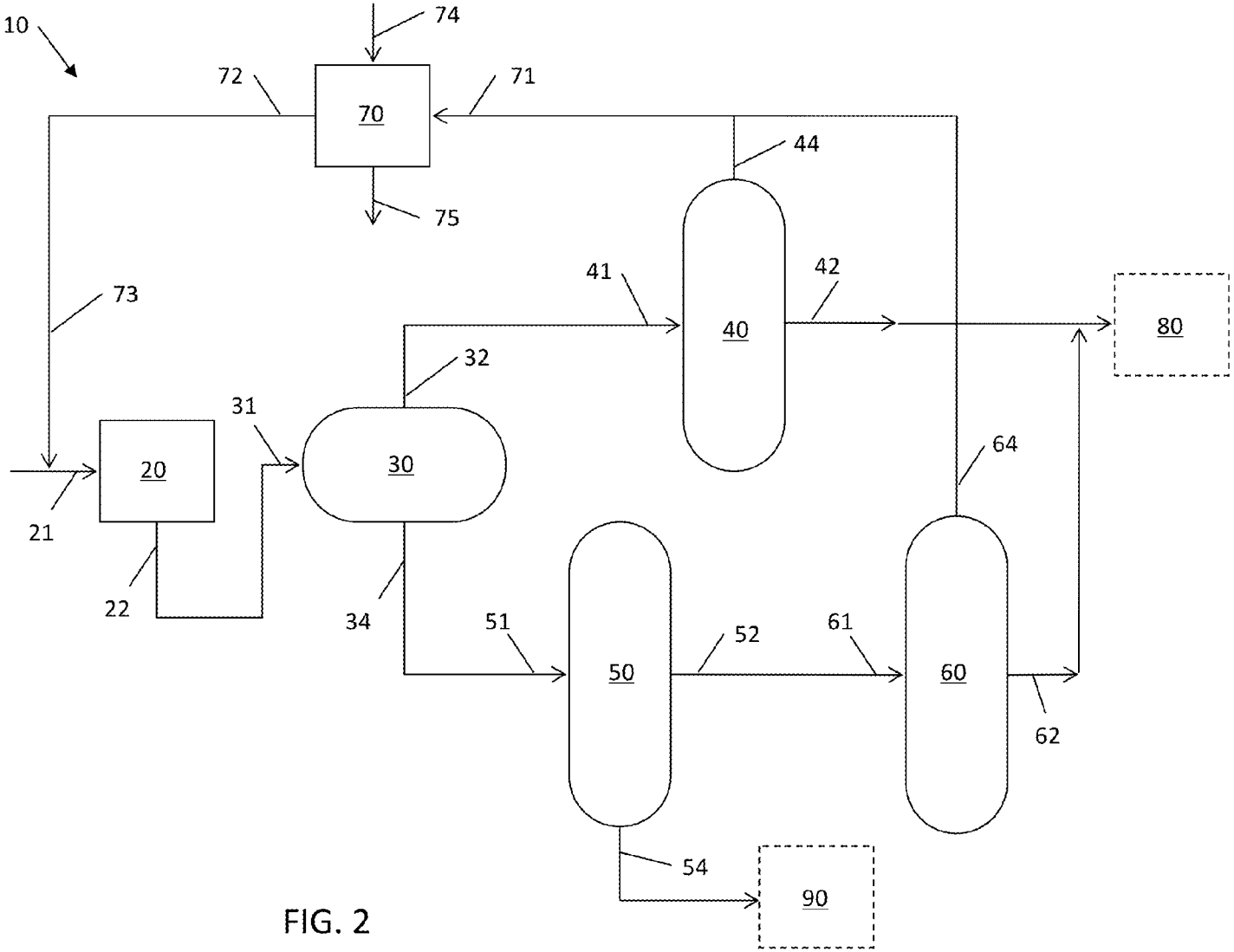
FIG. 2 is a schematic flow diagram of a heavy hydrocarbon feedstock stabilization system and process in accordance with the present invention.

Referring now to FIG. 2, a heavy hydrocarbon stabilization process and apparatus 10 is schematically illustrated. Apparatus 10 includes a heating vessel 20, a contact vessel 30, a first flash vessel 40, a second flash vessel 50, a third flash vessel 60, and a solvent tank 70. In another embodiment, apparatus 10 optionally includes a sediment-free hydrocarbon storage tank 80 and a sediment bottoms storage tank 90.

Heating vessel 20 includes an inlet 21 for receiving the heavy hydrocarbon feedstock. Inlet 21 is in fluid communication with a conduit 73 which is in fluid communication with an outlet 72 of the solvent tank 70 for transferring the solvent. Heating vessel 20 also includes an outlet 22 for discharging heated feedstock containing solvent-flocculated asphaltenes.

Contact vessel 30 includes an inlet 31 in fluid communication with outlet 22 of heating vessel 20, an outlet 32 for discharging a solvent/hydrocarbon phase and an outlet 34 for discharging the sediment phase.

First flash vessel 40 includes an inlet 41 in fluid communication with outlet 32 of contact vessel 30, an outlet 42 for discharging sediment-free hydrocarbon for further downstream processing or for storage in optional tank 80, and an outlet 44 for discharging solvent stream to storage tank 70.

Second flash vessel 50 includes an inlet 51 in fluid communication with the outlet 34 of contact vessel 30, an outlet 52 for discharging the light hydrocarbon fraction and an outlet 54 for discharging a sediment bottom to optional storage tank 90.

Third flash vessel 60 includes an inlet 61 in fluid communication with the outlet 52 of second flash vessel 50, an outlet 62 for discharging sediment-free hydrocarbon to optional storage tank 80 and an outlet 64 for discharging solvent stream to tank 70.

Solvent tank 70 includes an inlet 74 for receiving fresh solvent and an inlet 71 in fluid communication with outlet 44 of first flash vessel 40 and outlet 64 of third flash vessel 60 for receiving recovered solvent. Solvent tank 70 also includes an outlet 75 for discharging excess solvent and an outlet 72 which is in fluid communication with conduit 73 for conveying solvent to heating vessel 20.

In the practice of the method of the invention, a heavy hydrocarbon feedstock containing asphaltenes is mixed with the solvent in a ratio of solvent-to-feedstock of from 1:1 to 10:1 by volume. The ratio is based on an analysis of the feedstock and targeted stability of the treated stabilized feedstock in accordance IP-390 test method. The heavy hydrocarbon feed can be stabilized by removing from as little as 0.1 W % and up to 10 W % by the solvent-flocculation and treatment process of the invention. The combined stream is introduced into inlet 21 of heating vessel 20 and heated to from 100° C. to 300° C. to form solvent-flocculated asphaltenes in the feedstock. The heated feedstock containing solvent-flocculated asphaltenes is passed to contact vessel 30 where it forms a solvent/hydrocarbon phase and a sediment phase.

The solvent/hydrocarbon phase is passed to the first flash vessel 40 for the recovery of a solvent stream which is recovered via outlet 44 and stored in tank 70; a sediment-free hydrocarbon stream is discharged via outlet 42 and is either stored in tank 80, or subjected to further downstream processing. The sediment phase is passed to the second flash vessel 50 for recovery of a light hydrocarbon fraction that is discharged via outlet 52, and a sediment bottom that is discharged via outlet 54 and either stored in tank 90 or removed for appropriate disposition. The light hydrocarbon fraction is passed to the third flash vessel 60 for recovery of a sediment-free hydrocarbon stream that is discharged via outlet 62 and optionally stored in tank 80; the solvent stream is discharged in tank 70.

In certain embodiments, a feedstock such as whole crude oil is flashed prior to the addition of the solvent to remove light naphtha and other light components. The remaining portion that is substantially free of light naphtha is passed to the crude oil stabilization apparatus 10 and processed in accordance with the process described above.

In certain embodiments, before the sediment bottom is recovered and stored in tank 90, it is washed with hexadecane at a hexadecane-to-feedstock ratio of 5:1 by volume and/or a $C_5$ to $C_7$ light solvent such as pentane at a solvent-to-feedstock ratio in the range of about 1:1 by volume to remove remaining hydrocarbon feedstock and any other contaminants. The solvent can be recovered in a flash vessel for reuse.

The feedstocks for the heavy hydrocarbon stabilization process described herein are hydrocarbons derived from natural sources including whole crude oil, shale oils, coal liquids, bitumen, and tar sands, or those from refinery processes including vacuum gas oil, atmospheric or vacuum residue, products from coking, visbreaker and fluid catalytic cracking operations. The hydrocarbon feedstock has a boiling point above 36° C.

Suitable solvents include paraffinic solvents and heavy naphtha solvents. The paraffinic solvents have the general formula $C_nH_{2n+2}$, where n=10 to 20. Suitable paraffinic solvents include n-decane, n-undecane, n-dodecane, n-tridecane, n-tetradecane, n-pentadecane, n-hexadecane, n-heptadecane, n-octadecane, n-nonadecane, and n-eicosane. The heavy naphtha solvents can have a carbon number ranging from 10 to 20 and can be derived from crude oil or other intermediate refining processes, i.e., hydrocracking.

The contact vessel can be a batch vessel with an impeller, an extraction vessel, i.e., a centrifugal contactor, or contacting columns such as tray columns, spray columns, packed towers, rotating disc contactors and pulse columns. In general, the operating conditions for the contact vessel include a temperature of from 80° C. to 300° C., and in certain embodiments from 100° C. to 200° C.; a pressure of from 1 bar to 40 bars; a residence time of from 15 to 180 minutes, in certain embodiments from 35 to 90 minutes, and in further embodiments about 60 minutes.

The process of the invention represents an improvement over the prior art sludge treatment processes that is achieved by reducing sludge formation associated with heavy hydrocarbons by mixing one or more paraffinic or heavy naphtha solvents having carbon numbers in the range of from 10 to 20 with the feedstock to flocculate a predetermined and relatively small proportion of asphaltenes in the feedstock. In accordance with the present process, the heavy hydrocarbons are stabilized and the yield and quality of the treated hydrocarbon feed is not significantly affected by the solvent added.

EXAMPLES

Example 1

A hydrocarbon sample having an initial boiling point of 560° C., the properties of which are given in Table 2, was mixed with hexadecane at a 1:1 ratio by volume and maintained at 100° C. and atmospheric pressure for one hour. The combined product was filtered through a sintered glass filter having a 145 to 175 micron pore size, and 0.1 W % of asphaltenes were recovered.

TABLE 2

| | |
|---|---|
| Sulfur | 1.3 W % |
| Hydrogen | 10.0 W % |
| Nitrogen | 4,000 ppmw |
| Conradson Carbon Residue | 29 W % |
| Pentane Asphaltenes | 6 W % |
| Aromatics | 60 W % |

Example 2

A hydrocarbon sample having an initial boiling point of 290° C., the properties of which are given in Table 3, was mixed with hexadecane at a 1:1 ratio by volume and maintained at 100° C. and atmospheric pressure for one hour. The combined product was filtered through a sintered glass filter having 145 to 175 micron pore size, and 0.4 W % of asphaltenes were recovered.

TABLE 3

| | |
|---|---|
| Sulfur | 1.5 W % |
| Hydrogen | 11.2 W % |
| Nitrogen | 2,200 ppmw |
| Conradson Carbon Residue | 15 W % |
| Pentane Asphaltenes | 3 W % |
| Aromatics | 48 W % |

Example 3

A hydrocarbon sample having an initial boiling point of 210° C., the properties of which are given in Table 4, was mixed with hexadecane at a 1:1 ratio by volume and maintained at 100° C. and atmospheric pressure for 1 hour. The combined product was filtered through a sintered glass filter having 145 to 175 micron pore size, and 0.5 W % of asphaltenes were recovered.

TABLE 4

| | |
|---|---|
| Sulfur | 1.0 W % |
| Hydrogen | 10.7 W % |
| Nitrogen | 2,000 ppmw |
| Conradson Carbon Residue | 15 W % |
| Pentane Asphaltenes | 3 W % |
| Aromatics | 44 W % |

Example 4

A crude oil sample having an initial boiling point of 36° C. and an API gravity of 27.2°, the properties of which are given in Table 5, was mixed with hexadecane at a hexadecane-to-crude oil ratio of 1:1 by volume and maintained at 100° C. and atmospheric pressure for one hour. The combined product was filtered through a sintered glass filter having 145 to 175 micron pore size. The residue was washed with hexadecane at a hexadecane-to-crude oil ratio of 5:1 by volume and then with pentane at a pentane-to-crude oil ratio of 1:1 by volume and 1.4 W % of asphaltenes were obtained.

TABLE 5

| | |
|---|---|
| Sulfur | 3.0 W % |
| Nitrogen | 1,430 ppmw |
| Conradson Carbon Residue | 15 W % |

Example 5

A sample of the same crude oil used in Example 4 was mixed with hexadecane at a hexadecane-to-crude oil ratio of 1:5 by volume and maintained at 100° C. and atmospheric pressure for one hour. The combined stream was filtered through a sintered glass filter having 145 to 175 micron pore size. The residue was washed with pentane at a pentane-to-crude oil ratio of 5:1 by volume. 2.9 W % of asphaltenes were obtained.

The method and system of the invention have been described above and in the attached drawings; however, modifications will be apparent to those of ordinary skill in the art from this description and the scope of protection for the invention is to be determined by the claims that follow.

We claim:

1. A treatment process for the stabilization of a feedstock of heavy hydrocarbons that contain asphaltenes to prevent or reduce sludge formation in storage tanks and/or transportation lines by removing a portion of the asphaltenes that are sediment precursors present in the feedstock to reduce sediment formation, the process comprising:

a. mixing a predetermined quantity of solvent with the heavy hydrocarbon feedstock containing asphaltenes in order to solvent-flocculate asphaltenes that are sediment precursors, wherein the solvent is selected from the group consisting of a paraffinic solvent having a formula $C_nH_{n+2}$, where n=10 to 20 and heavy naphtha solvent having a carbon number in the range of from 10 to 20 to form a mixture consisting of the feedstock of heavy hydrocarbons that contain asphaltenes and the solvent;

b. heating the mixture of feedstock and solvent to produce solvent-flocculated asphaltenes that are sediment precursors in the feedstock;

c. separating the feedstock containing solvent-flocculated asphaltenes in a contact vessel into a solvent/hydrocarbon phase and a sediment phase;

d. flashing the solvent/hydrocarbon phase to produce a sediment-free hydrocarbon fraction and a solvent fraction;

e. flashing the sediment phase to produce a sediment bottom fraction and a light hydrocarbon fraction;

f. flashing the light hydrocarbon fraction to produce a sediment-free hydrocarbon fraction and a solvent fraction;

recycling the solvent fractions produced in steps (d) and (f) to step (a); and h. recovering the sediment-free hydrocarbon fractions produced in steps (d) and (f).

2. The process of claim 1 in which the ratio of solvent-to-feedstock is in the range of from 1:1 to 10:1 by volume.

3. The process of claim 1 in which the operating temperature of the contact vessel is in the range of from 80° C. to 300° C.

4. The process of claim 1 in which the operating pressure of the contact vessel is in the range of from 1 bar to 40 bars.

5. The process of claim 1 in which the residence time of the mixture in the contact vessel is in the range of from 15 minutes to 180 minutes.

6. The process of claim 1 which includes analyzing a sample of the feedstock that is to be subjected to the stabilization process to determine the solvent-to-feedstock ratio required to solvent-flocculate the asphaltenes that are sediment precursors.

7. The process of claim 6 in which the amount of solvent-flocculated asphaltenes recovered from the feedstock is from 0.01 W % to 10.0 W %, based on the weight of the feedstock.

8. The process of claim 1, wherein the feedstock is derived from an unrefined hydrocarbon source selected from the group consisting of whole crude oil, bitumen, tar sands, shale oils, coal liquefaction liquids, and combinations thereof.

9. The process of claim 1, wherein the heavy hydrocarbon feedstock is derived from a refined hydrocarbon source selected from the group consisting of atmospheric residue, vacuum residue, visbreaker products, fluid catalytic cracking products or by-products, and combinations thereof.

10. The process of claim 1, wherein the heavy hydrocarbon feedstock is a mixture boiling above 36° C.

11. The process of claim 1 where the heavy hydrocarbon feedstock is whole crude oil and the process includes the step of flashing the feedstock and recovering light naphtha and other light components before the feedstock is mixed with the solvent.

* * * * *